US007115005B2

(12) United States Patent
Zhu et al.

(10) Patent No.: US 7,115,005 B2
(45) Date of Patent: Oct. 3, 2006

(54) ELECTRICAL CONNECTOR HAVING RESILIENT CONTACTS

(75) Inventors: YunLong Zhu, Kunsan (CN); Guohua Zhang, Kunsan (CN); Jinkui Hu, Kunsan (CN)

(73) Assignee: Hon Hai Precision Inc. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/026,069

(22) Filed: Dec. 30, 2004

(65) Prior Publication Data

US 2005/0260898 A1 Nov. 24, 2005

(30) Foreign Application Priority Data

May 21, 2004 (CN) ..... 2004 2 0273250 U

(51) Int. Cl.
*H01R 4/48* (2006.01)

(52) U.S. Cl. ..... 439/862; 439/66

(58) Field of Classification Search ..... 439/66, 439/591, 862, 701

See application file for complete search history.

(56) References Cited

U.S. PATENT DOCUMENTS 5,904,597 A 5/1999 Doi et al.
6,315,621 B1 11/2001 Natori et al.
6,482,041 B1 * 11/2002 Yu-Feng ..... 439/630
6,500,026 B1 * 12/2002 Yamaguchi ..... 439/577
6,589,082 B1 * 7/2003 Harasawa et al. ..... 439/752
6,921,270 B1 * 7/2005 Mendenhall et al. ..... 439/66
2004/0132319 A1 * 7/2004 Richter et al. ..... 439/66

FOREIGN PATENT DOCUMENTS

TW 417891 1/2001

* cited by examiner

*Primary Examiner*—Tho D. Ta
*Assistant Examiner*—Vanessa Girardi
(74) *Attorney, Agent, or Firm*—Wei Te Chung

(57) ABSTRACT

An electrical connector (1) mounted on a circuit board is provided for mating with an electric device. The electrical connector includes a dielectric housing (10) having a terminal passage (16), a pair of conductive contact elements (20) received in the housing, and a fixing pad (30) connecting the circuit board. Each conductive contact element includes a base portion (21) positioned in the terminal passage, a tail portion (22) arranged on one side of the housing for connecting with a circuit board, a contacting portion (24) which serves for contacting the electric device, and a spring portion (23) connecting the contacting portion resiliently to the base portion. The fixing pad is fixed to the other side of the housing for providing balanced force acted on the electrical connector during mating with the electric device.

15 Claims, 5 Drawing Sheets

ELECTRICAL CONNECTOR HAVING RESILIENT CONTACTS

BACKGROUND OF THE INVENTION

1. Field of the Invention

The present invention generally relates to the art of electrical connectors and more particularly, to an electrical connector having resilient contacts for connecting with a complementary electrical connector.

2. Description of the Prior Art

Spring contacts for electrical interfaces are well known in the prior art and represent a wide family of technology for providing interconnection between electrical contact elements. A known type of such a conventional connector is disclosed in U.S. Pat. No. 6,315,621 B1 issued to Natori et al. on Nov. 13, 2001. The Natori connector comprises an insulator and a plurality of contact elements fixed to the insulator. The conventional contact element includes a fixing portion to be fixed to an insulator, a U-shaped portion connected to one end of the fixing portion, a contacting portion connected to the U-shaped portion, and a terminal portion connected to the other end of the fixing portion for being soldered to a circuit board.

However, the contact element relies upon the spring force substantially only from a resilient deformation of the U-shaped portion. The contact elements of the Natori connector may be distorted or become robustless after repeatedly mating with the complementary connector. In order to maintain a reliable contact between the contact elements, it is desired to make the U-shaped portion develop a considerably large spring bias. Moreover, the terminal portions of the Natori contact elements are arranged in a common side of the insulator. The Natori connector is mounted to the circuit board relies upon the terminal portion soldered to the circuit board only. Thus, soldering joints are easily damaged, resulting in an unreliable connection between the contact element and the circuit board, thereby rendering the connector inoperative. Particularly, to a heightened profile connector, the above-mentioned problems are more distinct.

Hence, an improved electrical connector having reliable contacts is desired to overcome the foregoing shortcomings.

BRIEF SUMMARY OF THE INVENTION

An object of the present invention is to provide an electrical connector for being mounted to a circuit board which is insensitive to vibrations.

An other object of the present invention is to provide an electrical connector having improved contacts with good elasticity.

An electrical connector mounted on a circuit board is provided for mating with an electric device. The electrical connector includes a dielectric housing having a terminal passage, a pair of conductive contact elements received in the housing, and a fixing pad connecting the circuit board. Each conductive contact element includes a base portion positioned in the terminal passage, a tail portion arranged on one side of the housing for connecting with a circuit board, a contacting portion which serves for contacting the electric device, and a spring portion connecting the contacting portion resiliently to the base portion. The fixing pad is fixed to the other side of the housing for providing balanced force acted on the electrical connector during mating with the electric device.

Other objects, advantages and novel features of the invention will become more apparent from the following detailed description when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures.

DETAILED DESCRIPTION OF THE INVENTION

Figure 1:
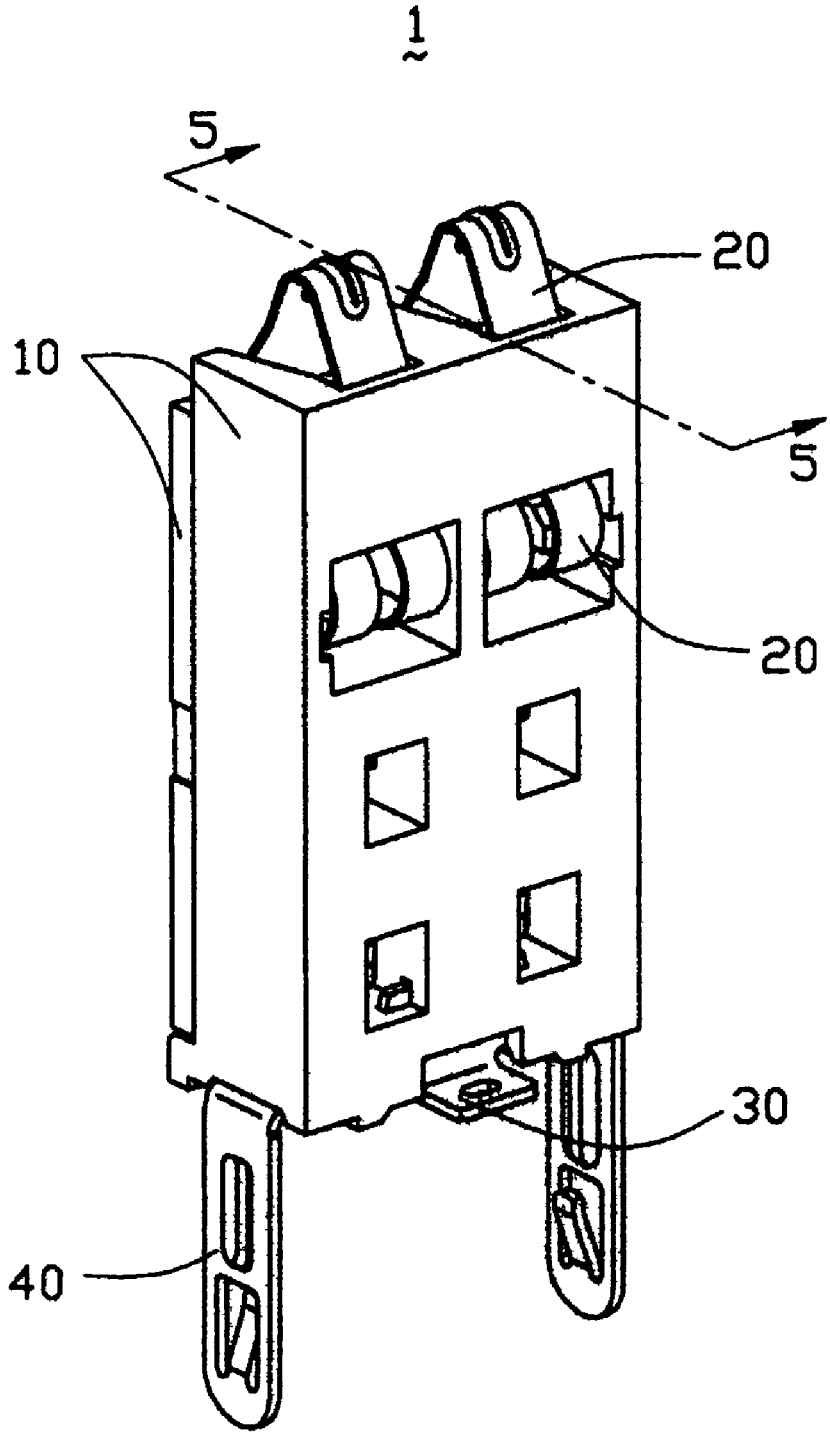
FIG. 1 is a perspective view of an electrical connector according to the present invention.
Figure 2:
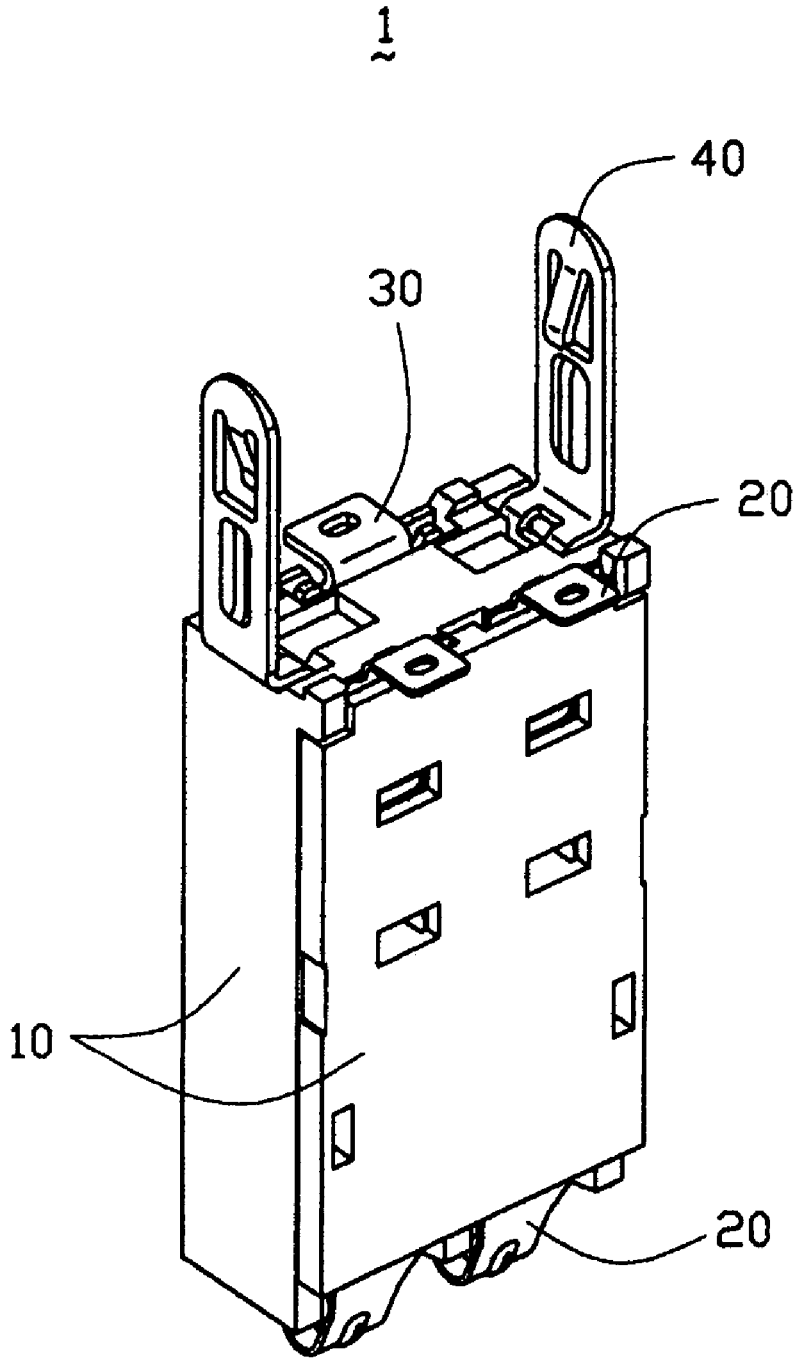
FIG. 2 is another perspective view of the electrical connector.

Referring to the drawings in greater detail, and first to FIGS. 1 and 2, the invention is embodied in an electrical connector, generally designated 1, which is mounted on a circuit board (not shown) for mating with an electric device, such as a battery or a complimentary connector. The electrical connector 1 comprises an elongate dielectric housing 10, a pair of conductive contacts 20, a pair of retention members 40, and a fixing pad 30 for providing balanced force acted on the electrical connector 1 during mating with the complimentary connector. However, it should be understood that various features of the invention are equally applicable for other types of connectors, as will be fully understandable from the following detailed description.

Figure 3:
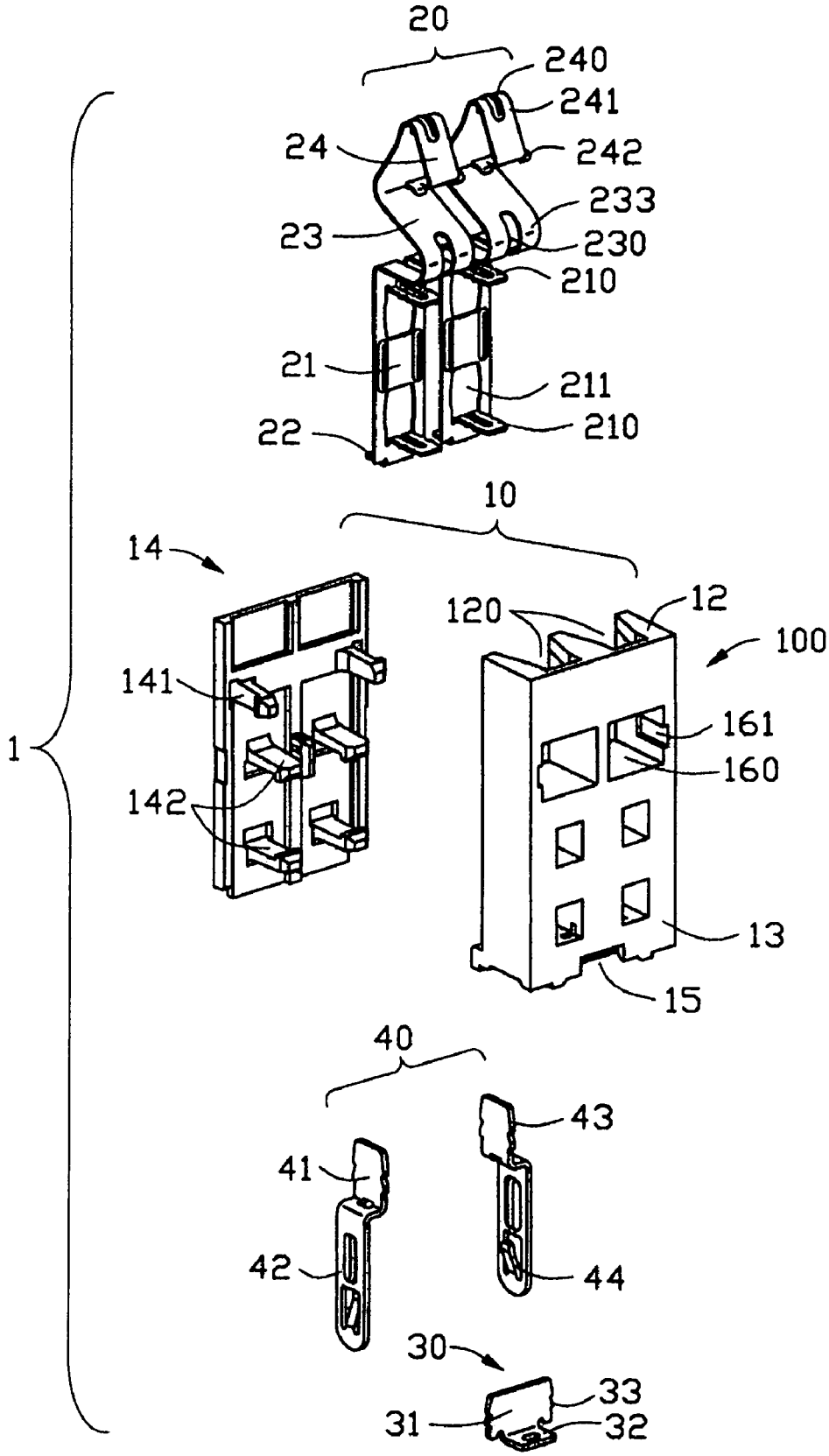
FIG. 3 is an exploded view of FIG. 1.
Figure 4:
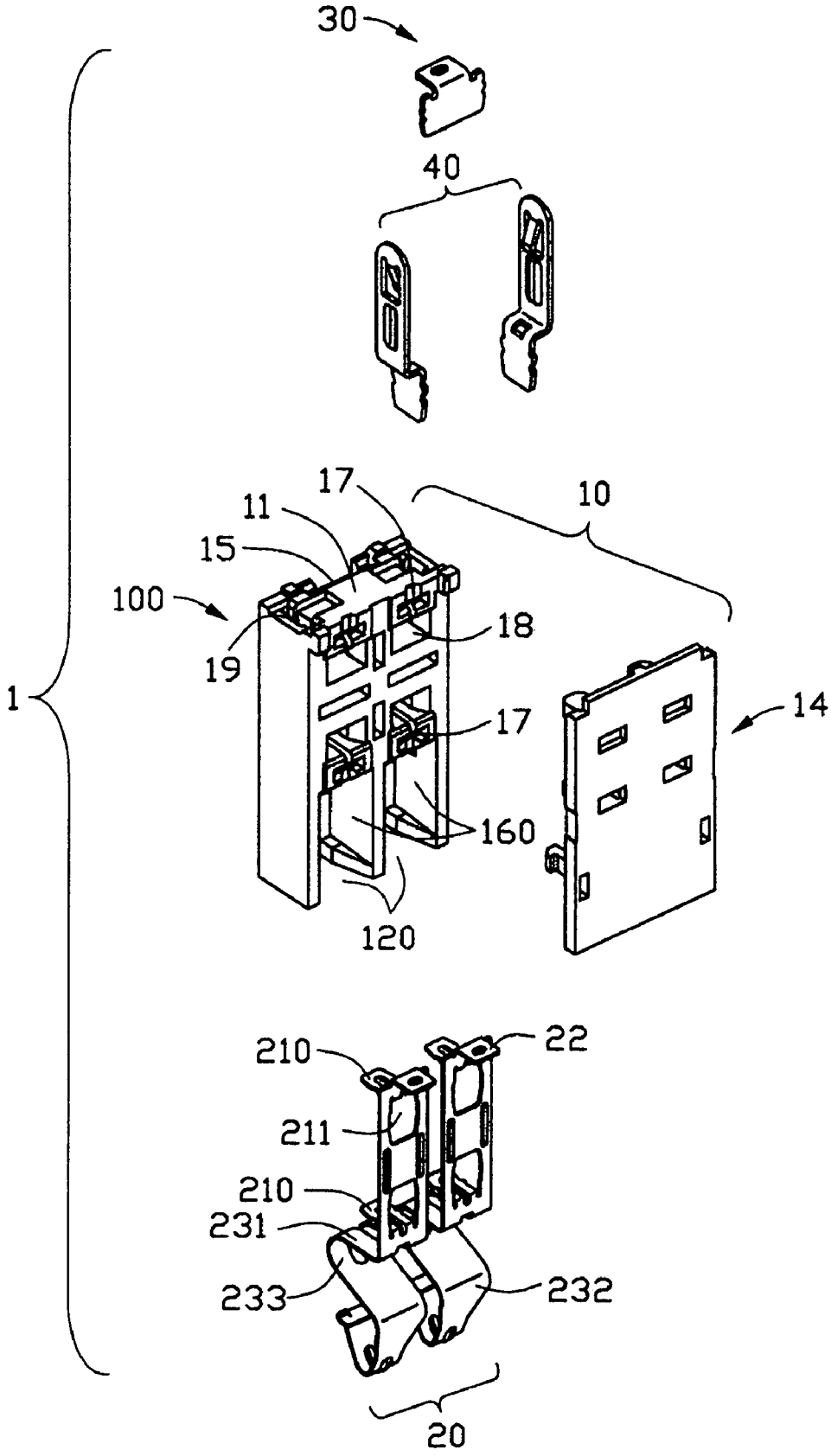
FIG. 4 is an exploded view of FIG. 2.
Figure 5:
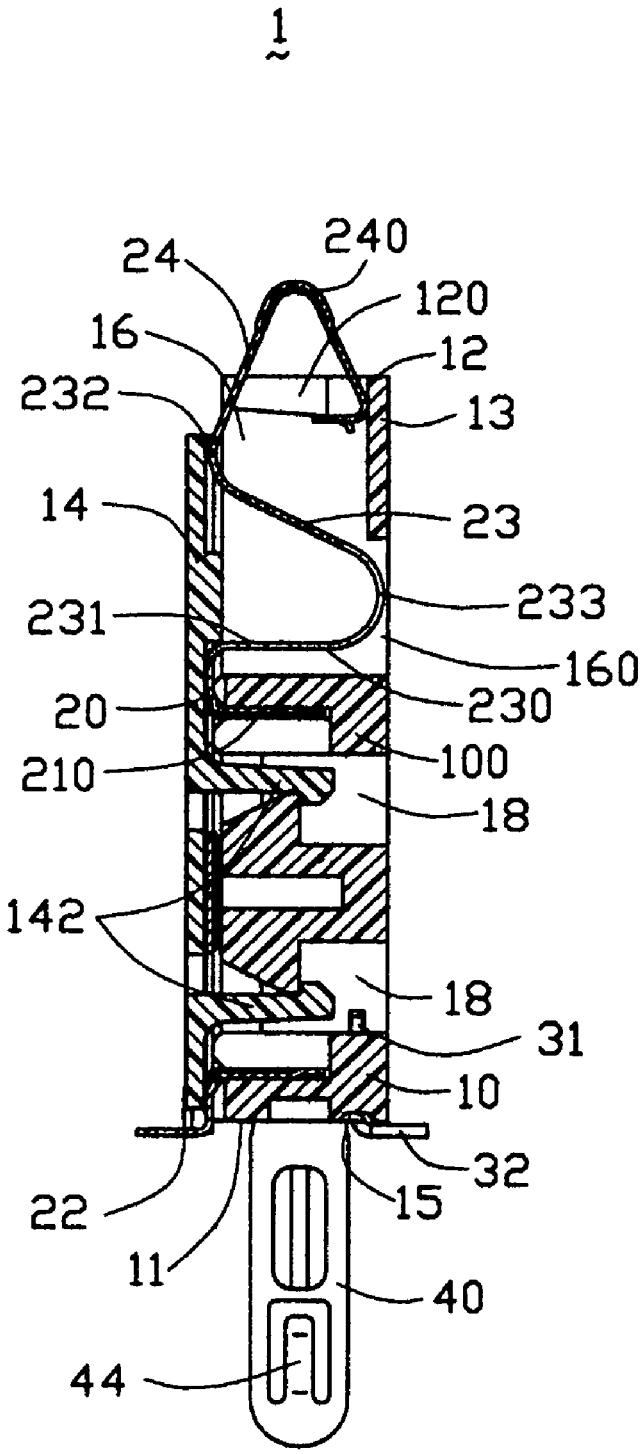
FIG. 5 is a cross-sectional view of FIG. 1 taken along line 5—5.

Referring to FIGS. 3–5 in conjunction with FIGS. 1–2, the housing 10 comprises a first housing member 100 and a second housing member 14 coupled to the first housing member 100 to define a pair of terminal passages 16 therebetween. The first housing member 100 includes a mating face 12 having a pair of holes 120 communicating with the terminal passages 16, a board mounting face 11, a sidewall 13 perpendicularly extending between the mating face 12 and the board mounting face 11. The sidewall 13 has a pair of cavities 160 communicating with the terminal passages 16 and adjacent to the mating face 12. A recess 161 is defined in each cavity 160 and extending outwardly from an inner side of each cavity 160. The first housing member 100 further defines a plurality of positioning holes 18 extending therethrough, and a plurality of fixing holes 17 in one side thereof and adjacent to respective ones of the positioning holes 18. A groove 15 is arranged in the other side of the first housing member 100 and exposed to the board mounting face 11 for receiving the fixing pad 30. A pair of retention holes 19 are defined in opposite sides of the board mounting face 11 for holding the retention members 40 therein. The second housing member 14 forms a pair of first positioning arms 141 for being fixed in the cavities 160, and a plurality of second positioning arms 142 for latchably engaging with respective ones of the positioning holes 18.

The conductive contact element 20 is produced from an electroconductive sheet material which has elasticity, or an elastic metal plate, by the use of a cutting apparatus such as a punch press. The contact element 20 comprises a base portion 21 to be positioned in the housing 10, a tail portion 22 extending from one end of the base portion 21 in a direction substantially perpendicular to the base portion 21 for connecting to the circuit board (not shown), a spring portion 23 connected to the other end of the base portion 21, and a contacting portion 24 resiliently connected to the spring portion 23 for contacting the electric device. The base portion 21 has a pair of fixing plate parts 210 stamped laterally therefrom for engaging with the fixing holes 17 of the housing 100, thereby leaving a pair of openings 211 for allowing the first and second positioning arms extending therethrough when the electrical connector 1 is assembled. The spring portion 23 and the contacting portion 24 are an elastic portion continuous to, or jointed at, or supported by, the one end of the base portion 21 and substantially curved in S-shape. The spring portion 23 comprises a first leg 231 bending from the base portion 21, a second leg 232 connected to the contacting portion 24, and a connection portion 233 arranged between the first and the second legs 231, 232. The spring portion 23 further defines a long slit 230 extending from the first leg 231 to the second leg 232. This design of the spring portion 23 serves to allow the displacement of the contacting portion 24 when the contacting portion 24 is pressed by the electric device (not shown) towards the base portion 10. Therefore, the contact element 20 can obtain high flexibility and greater rigidity in a longitudinal direction and allows good contacting of the electric device. The contacting portion 24 is curved in a U-shape at the connection of the spring portion 23. The width of the contacting portion 24 is smaller than that of the spring portion 23. The contacting portion 24 includes a curved section 241 with an elongate convexities 240 extending along the curved section 241, and a transverse strip 242 arranged at the end of the contacting portion 24. The transverse strip 242 is provided for cooperates with a stop of the terminal passage 16 of the housing 10 for the purpose of limiting the spring travel of the contacting portion 24.

Referring to FIGS. 3 and 4, the fixing pads 30 are provided for mounting on the circuit board. Each fixing pad 30 includes a fixing portion 31 having a plurality of barbs 33 for latchablely engaging with the housing 10, and a mounting portion 32 extending transversely from a bottom edge of fixing portion 31 for being mounted to the circuit board.

As best shown in FIGS. 3 and 4, each retention member 40 includes a retention arm 41 forming a plurality of bars 43 for being fixed in the housing 10, and an extending arm 42 bending outwardly and downwardly from a bottom edge of the retention arm 41. The extending arm 42 forms a locking tab 44 projecting inwardly in a lower portion thereof. The extending arm 42 serves to extend through the circuit board and latch with other electrical components (not shown) mounted the circuit board.

Referring to FIG. 5 and in conjunction with FIGS. 1 and 2, in assembly, the contact elements 20 are held in the first housing member 100 with the contacting portion 24 upwardly projecting beyond the mating face 12 of the first housing member 100. The fixing plate parts 210 of each contact element 20 are secured in the fixing holes 17 of the first housing member 100, the connection portion 233 of the spring portion 23 of each contact element 20 is exposed in the cavity 160, and the tail portion 22 extends beyond the board mounting face 11 for mounting to the circuit board. The fixing pad 30 is attached to the first housing member 100 with the fixing portion 31 retained in the groove 15 and the mounting portion 32 projecting beyond the board mounting face 11. It should be noted that the tail portions 22 of the contact element 20 and the mounting portion 32 of the fixing pad 30 are arranged on opposite sides of the first housing member 100 and respectively extending toward opposite directions to secure the electrical connector 1 to the circuit board. The retention members 40 are assembled to the first housing member 100 with the retention arms 41 fixed in the retention holes 19 respectively. The extending arms 42 of each retention member 40 downwardly projecting beyond the board mounting face 11. The second housing member 14 is organized to the first housing member 100. The first positioning arms 141 of the second housing member 14 are held in corresponding cavities 160 of the first housing member 100 by slight interference fit, and the second positioning arms 142 are interferentially fitted in the positioning holes 18, thereby securely assembling the second housing member 14 to the first housing member 100.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for contacting an electric device comprising:

a dielectric housing having a terminal passage defined therein;

a conductive contact element including a base portion positioned in the terminal passage, a tail portion arranged on one side of the housing for connecting with a circuit board, a contacting portion which serves for contacting the electric device, and a spring portion connecting the contacting portion resiliently to the base portion, the spring portion comprising a firt leg bending from the base portion, a second leg connected to the contacting portion, and a connection portion arranged between the first and the second legs, wherein the spring portion defines a long slit extending from the first leg to the second leg; and a fixing pad fixed to the other side of the housing for connecting to the circuit board.

2. The electrical connector according to claim 1, wherein the tail portion and the spring portion respectively connect with opposite ends of the base portion and are positioned in opposite sides of the base portion.

3. The electrical connector according to claim 2, wherein the base portion of the contact element has a fixing plate part extending laterally away from the tail portion, and wherein the housing defines a fixing hole holding the fixing plate part therein.

4. The electrical connector according to claim 1, wherein the spring portion and the contacting portion are substantially curved in S-shape and elastically supported by the base portion.

5. The electrical connector according to claim 1, wherein the spring portion has a serpentine shape and longitudinally extends between the base portion and the contacting portion.

6. The electrical connector according to claim 1, wherein the fixing pad includes a fixing portion latchablely engaging with the housing and a mounting portion extending transversely from a bottom edge of the fixing portion away from the tail portion of the contact element.

7. The electrical crnnector according to claim 1. wherein the housing includes detachable first and second housing members coupled with each other.

8. The electrical connector according to claim 7, wherein the first housing member defines a plurality of positioning holes, and wherein the second housing member defines a plurality of positioning arms interferentially fitted in corresponding positioning holes.

9. The electrical connector according to claim 1, wherein the width of the contacting portion is smaller than that of the spring portion.

10. The electrical connector according to claim 1. further including a pair of retention members fixed to the housing and extending downwardly to connect the circuit board.

11. The electrical connector according to claim 1, wherein the housing defines a cavity in a side thereof allowing the spring portion of the contact element to be exposed therein.

12. An electrical connector comprising:

a dielectric housing defining opposite upper mating and lower mounting faces thereon and further defining therein a contact-receiving passageway essentially extending along a first direction defined by said mating and mounting faces;

a conductive contact including a straight base portion with a retention section extending in a sccond direction perpendicular to said first direction for being fixed to the housing below the passageway, and a spring portion received in the contact-receiving passageway with a contacting portion at a free end thereof; and a housing cover fastened to said housing in said second direction and cooperating with said housing to protectively sandwich the base portion therebetween, wherein said contacting portion extends out of the mating face, and said housing further defines a cavity communicate the passageway with an exterior along said second direction.

13. The electrical connector as claimed in claim 12, wherein said contact defines a connection portion positioned around said cavity.

14. The electrical connector as claimed in claim 12, wherein said spring portion is moved in the passageway when the contacting portion is depressed by an electronic part.

15. An electrical connector comprising:

a housing assembly defining opposite mating and mounting faces;

a contact disposed in the housing with a contacting portion extending out of the mating face and a horizontal tail portion exposed out of one elongated side of the mounting face in a first horizontal direction;

a fixed pad attached to a bottom portion of the housing and including a horizontal section extending out of the other elongated side of the mounting face in a second direction opposite to said first direction; and a pair of retention members extending downwardly beyond the mounting face on two opposite lateral sides of the housing which are perpendicular to said elongated sides.

* * * * *